US011102866B2

(12) United States Patent
Görgen

(10) Patent No.: US 11,102,866 B2
(45) Date of Patent: Aug. 24, 2021

(54) ILLUMINATION CONTROL

(71) Applicant: SIGNIFY HOLDING B.V., Eindhoven (NL)

(72) Inventor: Daniel Görgen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 110 days.

(21) Appl. No.: 16/305,585

(22) PCT Filed: May 22, 2017

(86) PCT No.: PCT/EP2017/062252
§ 371 (c)(1),
(2) Date: Nov. 29, 2018

(87) PCT Pub. No.: WO2017/207321
PCT Pub. Date: Dec. 7, 2017

(65) Prior Publication Data

US 2020/0329544 A1 Oct. 15, 2020

(30) Foreign Application Priority Data

May 30, 2016 (EP) ..... 16171924

(51) Int. Cl.
*H05B 47/14* (2020.01)
*H05B 47/10* (2020.01)

(52) U.S. Cl.
CPC ..... *H05B 47/10* (2020.01); *H05B 47/14* (2020.01)

(58) Field of Classification Search
CPC ..... H05B 47/14; H05B 47/10
See application file for complete search history.

(56) References Cited

U.S. PATENT DOCUMENTS

| | | | | |
|---|---|---|---|---|
| 7,925,384 | B2 * | 4/2011 | Huizenga | H05B 47/19 700/277 |
| 8,928,232 | B2 * | 1/2015 | Aggarwal | H05B 47/11 315/153 |
| 9,081,265 | B2 | 7/2015 | Spaulding et al. | |
| 9,271,367 | B2 * | 2/2016 | Ivey | H05B 47/19 |
| 9,345,103 | B1 * | 5/2016 | Letourneur | H05B 45/20 |
| 9,532,422 | B2 * | 12/2016 | Hinrichs | H05B 45/10 |
| 9,807,849 | B2 * | 10/2017 | Bhatkar | H05B 47/105 |
| 10,454,783 | B2 * | 10/2019 | Burks | H04L 12/281 |
| 10,484,827 | B2 * | 11/2019 | Baker | G05D 23/1905 |

(Continued)

FOREIGN PATENT DOCUMENTS

| | | | |
|---|---|---|---|
| CN | 102004469 | A | 4/2011 |
| EP | 2884195 | A1 | 6/2015 |

(Continued)

*Primary Examiner* — Nay Tun

(57) ABSTRACT

A method and apparatus for controlling distribution of illumination information in an illumination system, wherein illumination settings to be sent for storing at one or more luminaires are determined based on one or more priority metrics. Priority metrics may be based on previous usage of an illumination setting, or the content of an illumination setting for example. The determination and sending can be commenced by a trigger such as a time of day or a user input, and evaluation of priority metrics can be performed to so that illumination settings are stored intelligently based on a user profile, preference or schedule.

18 Claims, 5 Drawing Sheets

(56) References Cited

U.S. PATENT DOCUMENTS 10,499,477 B2 * 12/2019 Chen ..... H05B 47/12
2002/0078221 A1 6/2002 Blackwell et al.
2006/0193125 A1 8/2006 Fluss
2007/0258243 A1 * 11/2007 Segall ..... H05B 47/10 362/276
2008/0071391 A1 * 3/2008 Busby ..... G05B 15/02 700/12
2009/0230894 A1 * 9/2009 De Goederen ..... H05B 47/19 315/314
2009/0243517 A1 * 10/2009 Verfuerth ..... H05B 47/16 315/315
2010/0185339 A1 * 7/2010 Huizenga ..... H05B 47/19 700/295
2010/0259197 A1 * 10/2010 Boleko Ribas ..... H05B 47/155 315/312
2014/0062340 A1 * 3/2014 Elgayyar ..... H05B 47/175 315/360
2014/0070706 A1 * 3/2014 Fushimi ..... H05B 47/10 315/131
2014/0252987 A1 * 9/2014 Hinrichs ..... H05B 45/20 315/297
2014/0266600 A1 * 9/2014 Alberth, Jr. ..... G06F 21/32 340/5.83
2014/0354161 A1 * 12/2014 Aggarwal ..... H05B 47/105 315/153
2015/0008845 A1 * 1/2015 Kim ..... G06F 3/04847 315/292
2015/0350031 A1 * 12/2015 Burks ..... G06F 3/0482 715/736
2016/0095188 A1 * 3/2016 Verberkt ..... H05B 47/11 315/151
2016/0286627 A1 9/2016 Chen et al.
2017/0156193 A1 * 6/2017 Meerbeek ..... H05B 47/19
2017/0206721 A1 * 7/2017 Koo ..... H04B 10/116
2017/0290132 A1 * 10/2017 Amrine ..... H05B 47/11
2017/0295624 A1 * 10/2017 Lark, Jr. ..... H05B 41/02

FOREIGN PATENT DOCUMENTS

WO 2013029630 A1 3/2013
WO 2015025267 A1 2/2015

* cited by examiner

Scene X

| Luminaire | 1 | 2 | 3 | 4 | 5 |
|---|---|---|---|---|---|
| Brightness | 24 | 24 | - | 16 | - |
| Colour | 122 | 248 | - | 122 | - |
| Effect | - | - | - | - | - |

Figure 3

Luminaire 1

| Scene | X | Y | Z |
|---|---|---|---|
| Brightness | 24 | 12 | 16 |
| Colour | 122 | 88 | 50 |
| Effect | - | - | - |

Figure 4

ILLUMINATION CONTROL

CROSS-REFERENCE TO PRIOR APPLICATIONS

This application is the U.S. National Phase application under 35 U.S.C. § 371 of International Application No. PCT/EP2017/062252, filed on May 22, 2017, which claims the benefit of European Patent Application No. 16171924.0, filed on May 30, 2016. These applications are hereby incorporated by reference herein.

TECHNICAL FIELD

The present disclosure relates to control and storage of illumination information in an illumination system.

BACKGROUND

"Connected lighting" refers to a system of luminaires which are controlled not by (or not only by) a traditional wired, electrical on-off or dimmer circuit, but rather via a wired or more often wireless network using a digital communication protocol. Typically, each of a plurality of luminaires, or even individual lamps within a luminaire, may each be equipped with a wireless receiver or transceiver for receiving lighting control commands from a lighting control device according to a wireless networking protocol such as ZigBee, Wi-Fi or Bluetooth (and optionally also for sending status reports to the lighting control device using the wireless networking protocol).

Luminaires may have individually controllable parameters, such as brightness and colour, and one or more luminaires may be controlled together in a group in a coordinated manner to create an overall light distribution, or scene, for illuminating an area or space such as room in a desired manner. Combinations of different luminaires and/or different settings of the luminaires can achieve a different overall illumination of the area of space, as desired.

Rather than having to control individual luminaires, or even individual settings for the or each luminaire, in order to achieve a desired illumination, it is usually preferable for groups of settings to be stored together corresponding to a desired light distribution, or scene. For example a "morning" scene, or a "relaxing" scene can be created, which can then be recalled quickly and easily by a user with a single command. The switch to the recalled settings should preferably be perceived by the user synchronously across all luminaires included in the group

SUMMARY

Recalling a group of settings in this way may be achieved by storing the various individual settings in the individual luminaires with a given identifier, and effecting the settings by sending an instruction referencing the identifier of the given light distribution or scene (e.g. "morning", or "relaxing") using group cast, allowing substantially simultaneous recall.

However, storage capacity in the individual luminaires may be limited, and it may be necessary for some stored settings to be held in a lighting control device, (for example a smartphone or dedicated wall panel, as will be explained in greater detail below). In this case, the scene is typically recalled by unicasting the appropriate settings to each individual luminaire where such settings are not stored locally at the luminaire. This may result in settings being received at different luminaires at different times, and if these time differences are sufficiently large, it is undesirably perceivable by the user.

It would be desirable to provide improved illumination control.

Accordingly, in one aspect of the invention there is provided an illumination controller comprising a distribution controller, adapted to determine illumination settings to be stored at one or more luminaires, and a distributor, adapted to send determined illumination settings to the one or more luminaires, for storing; wherein the distribution controller is adapted to obtain one or more priority metrics for illumination settings, and determination of an illumination setting to be stored at the one or more luminaires is based on said one or more priority metrics.

In this way, the illumination controller can advantageously prioritise the illumination settings stored in the luminaires, to correspond to those predicted, or most likely to be desired by a user at a given time and/or in a given situation. Conversely, the need for illumination settings corresponding to a selected scene to be downloaded or transferred to the luminaires upon selection by a user is reduced, even in cases where storage is limited at luminaires. As explained above, this reduces the likelihood of the selected scene, or change of scene, to be perceived as asynchronous.

Relative priority or suitability of all available illumination settings, or of only a subset of illumination settings may be determined. In embodiments, priority relative to settings already stored in luminaires is determined.

One factor which can be used as a metric, or on which a priority metric can be based, and hence used to determine settings for sending and storing, is the previous usage of a given illumination setting. For example when a particular illumination setting was created or last used, or how often a given illumination setting has been used and by whom, or other measures of statistics or patterns of use may be taken into consideration.

Further factors which can be used as a metric, or on which a priority metric can be based derive from the data content of the setting itself.

In embodiments, the illumination settings specify one or more parameters such as brightness or intensity, colour or hue, effect or timing parameters, and optionally an on/off parameter. These parameters can be used to define a light state for each luminaire. An illumination setting may specify the light state of a single luminaire, but will more commonly identify a group of luminaires, and the light states of the group (which may be the same light state, or different light states) to create a desired lighting scene.

It has been found to be desirable to prioritise settings which require longer to transmit to the luminaires, therefore in embodiments, the total number of luminaires associated with or included in an illumination setting may be used as, or to obtain, a priority metric. This reflects the increased time taken to address multiple individual luminaires. However the information provided to one or each luminaire can also be considered—the number of different lighting parameters (e.g. brightness, colour, etc) to be communicated or a measure of the overall data content may be used as, or to generate, a priority metric, with more data generally implying a greater transmission time, and hence a higher priority.

As will be explained, it is possible for some, but not all luminaires to have relevant settings stored locally. While in some embodiments, there may be benefit in sending settings to some, but not all, luminaires, to reduce the number of luminaires in a setting which still requires parameter values to be unicast, other embodiments may allow an assessment of whether all luminaires of a scene are able to be store the relevant settings, so only 'complete' scenes are sent.

It has been recognised that the probability of an illumination setting being desired may further depend on factors present in the environment of the illumination controller, or the luminaires or the space which it is adapted to illuminate. For example, a priority metric may be, or may be based on the ambient lighting conditions, the presence of a person or persons nearby, and the identity of such persons. A priority metric may also be based on, or relate to, the time of day.

In embodiments, a priority metric or metrics will typically take into account combinations of factors, such as those provided above, and metrics may be assigned weightings in such combinations. A set of rules or logic expressions can be used to combine or compare various metrics, optionally in combination with external variables and inputs, such as time of day or ambient lighting, to determine the relative priorities of illumination settings corresponding to user profiles, preferences or schedules. The particular rules or expressions used can be determined in advance, based on testing for example, or can be updated by the controller in situ, using machine learning for example, based on user inputs and patterns of use.

The determination of the illumination settings to be sent, and the sending, are controlled based on a trigger event or events in certain embodiments. A trigger event may be clock based, for example occurring at set times of the day, or at predetermined intervals. Alternatively the controller can be responsive to a trigger such as the input/creation of a new illumination setting or settings, the use/recall of an illumination scene by a user, or the detected presence of a user.

The determination and the sending are generally considered as being controlled together and occurring substantially simultaneously, however determination and sending could be separately controlled, and determination could for example be performed more frequently, perhaps substantially continuously, with the resulting settings being sent when only as required or triggered.

As will be understood, some priority metrics are substantially fixed, such as the number of luminaires in an illumination setting for a given scene, or a metric which relates to a fixed time of day. Such metrics can be stored and referenced by the controller. Other metrics will vary with time, such as statistical patterns of use, and will typically be determined dynamically.

As has been described above, in embodiments of the invention, the controller is able to obtain suitable metrics for illumination settings which allow the illumination settings to be evaluated in context, to determine relative suitability or probability of being required in a given situation. The illumination settings stored in the luminaires can then be updated and maintained intelligently over time. By virtue of such intelligent prioritisation, an illumination setting instructed or recalled by a user will usually, or more often, be pre-stored in the respective luminaires, and the resulting illumination effect will be perceived synchronously. According to embodiments, even in a case that the desired setting is not pre-stored, by virtue of intelligent prioritisation, such a setting will have decreased probability of delay, and hence being perceived as asynchronous.

In a further aspect of the invention there is provided an illumination system comprising an illumination controller substantially as already described, and one or more luminaires, said luminaires adapted to receive and store illumination settings sent from said illumination controller.

In a still further aspect of the invention, there is provided a method of controlling distribution of illumination information in an illumination system, said method comprising determining illumination settings to be stored at one or more luminaires based on one or more priority metrics, and sending determined illumination settings to the one or more luminaires for storing.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention extends to methods, apparatus and/or use substantially as herein described with reference to the accompanying drawings.

Any feature in one aspect of the invention may be applied to other aspects of the invention, in any appropriate combination. In particular, features of method aspects may be applied to apparatus aspects, and vice versa.

Furthermore, features implemented in hardware may generally be implemented in software, and vice versa. Any reference to software and hardware features herein should be construed accordingly.

BRIEF DESCRIPTION OF THE DRAWINGS

Preferred features of the present invention will now be described, purely by way of example, with reference to the accompanying drawings, in which:

FIG. 3 illustrates data representing illumination setting for an example scene;

FIG. 4 illustrates data representing parameter values stored in an example luminaire;

DETAILED DESCRIPTION OF EMBODIMENTS

Figure 1:
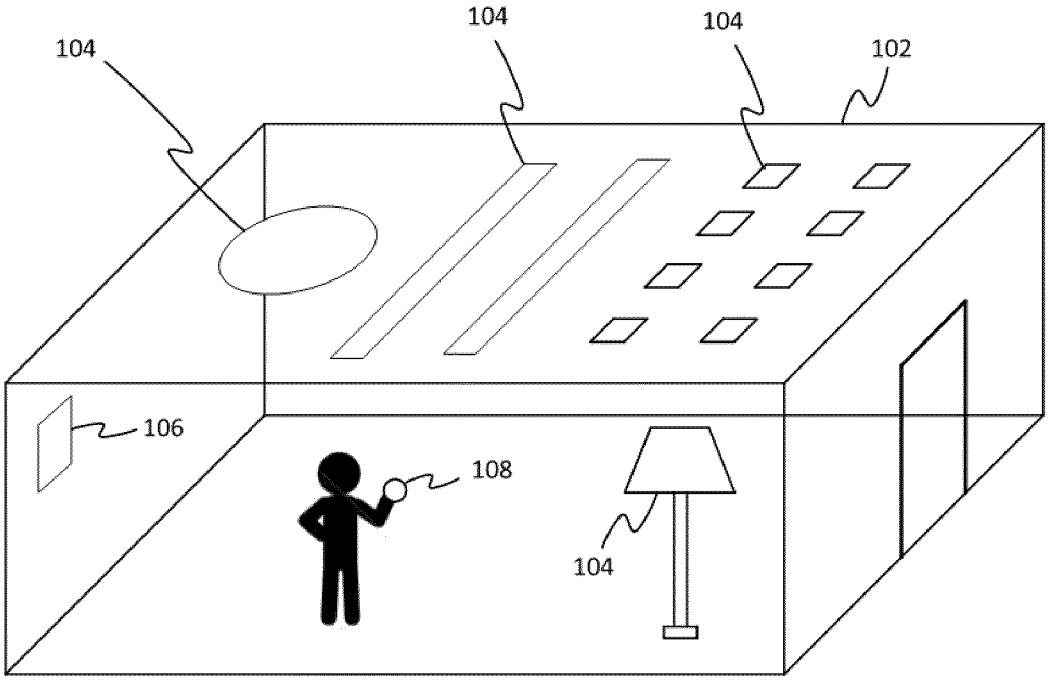
FIG. 1 shows an example of a lighting system installation.

FIG. 1 shows a lighting system installed or otherwise disposed in an environment 102, e.g. an indoor space such as a room, or an outdoor space such as a garden or park, or a partially covered space such as a gazebo, or any other space that can be occupied by one or more people such as the interior of a vehicle. The lighting system comprises one or typically a plurality of luminaires 104, each comprising one or more lamps (illumination emitting elements) and any associated housing, socket(s) and/or support. LEDs may be used as illumination emitting elements, but other alternatives such as incandescent lamps eg halogen lamps. A luminaire 104 is a lighting device for emitting illumination on a scale suitable for illuminating an environment 102 occupiable by a user. For example, a luminaire 104 may be a ceiling mounted luminaire, such as a spotlight or wall washer, a wall mounted luminaire, such as an uplighter or downlighter, or a free standing luminaire such as a floor lamp or desk lamp for example (and each need not necessarily be of the same type). A user can control the lighting system via a user terminal such as a wall panel 106. Alternatively or additionally a mobile user terminal 108 may be provided in order to allow the user to control the lighting system. This will typically be in the form of a smartphone or tablet for example, running an application or "app". The user terminal or terminals comprise a user interface such as a touchscreen or a point-and-click interface arranged to enable a user (e.g. a user present in the environment 102, or located remotely in the case of a mobile terminal) to provide user inputs to the lighting control application.

Figure 2:
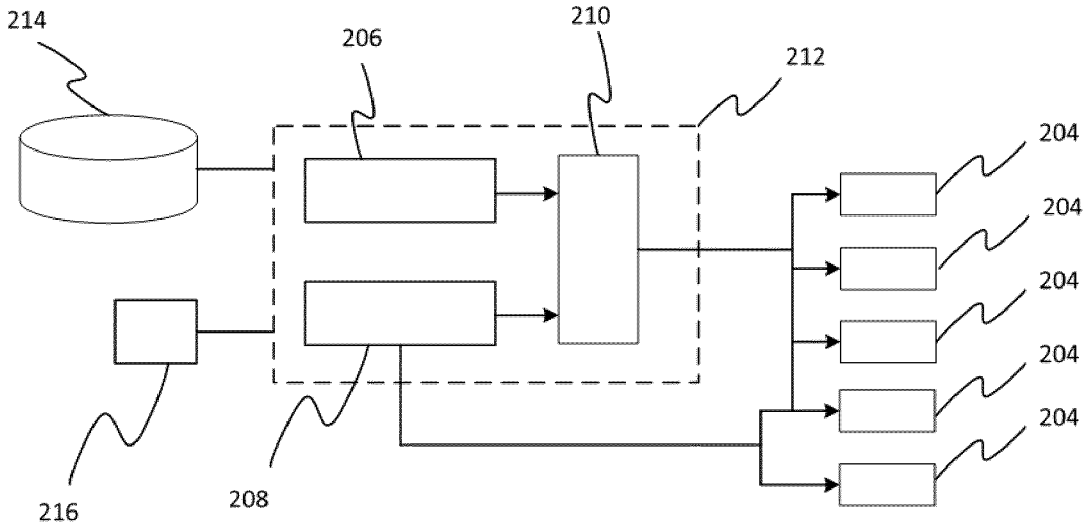
FIG. 2 illustrates a lighting system schematically.

Referring to FIG. 2, an example of a lighting system is shown schematically. A user terminal 206, connects to luminaires 4 via an intermediate device 210 such as a wireless router, access point or lighting bridge. User terminal 206 could for example be the wall panel 106 of FIG. 1, and the intermediate device could be integrated in the wall panel or provided as a separate device. User terminal 208 is a mobile user terminal, such as terminal 108 of FIG. 1, and may also connect to the lumaires via the device 210, but may additionally or alternatively connect to the luminaires directly without an intermediate device. Connection between the devices may be wired, using a protocol such as DMX or Ethernet, or wireless using a networking protocol such as ZigBee, Wi-Fi or Bluetooth for example. Luminaires may be accessible only via device 210, only directly from a user terminal, or both.

For instance the user terminal 206 may connect to the intermediate device 210 via a first wireless access technology such as Wi-Fi, while the device 201 may connect onwards to the luminaires 4 via a second wireless access technology such as ZigBee. In this case intermediate device 210 converts the lighting control commands from one protocol to another.

Device 210 and user terminals 206 and 208 comprise a functional group illustrated schematically by dashed line and labelled 212. This functional group may further be connected to a storage device or server 214, which may be part of a network or the internet for example. Each element of the group 212 may include a memory, or have access to a storage function, which may be provided by storage device or server 214. Luminaires 204, or at least some of the luminaires 204, also include a memory.

This arrangement allows input of user commands at the user interface of a user terminal 206 or 208, and transmission of corresponding control signals to appropriate luminaires for changing illumination (e.g. recalling a particular scene). This arrangement also allows obtaining, storing, evaluating, selecting and distributing or dispatching of illumination settings, which functions are advantageously performed autonomously, in the background, without direct user intervention.

The function of determining illumination settings, and distributing determined settings to appropriate luminaires is preferably provided by one, or a combination of elements in the functional group shown schematically in dashed line and labelled 212, however some functionality may be distributed to the storage device or server 214.

Illumination settings can be created by a user by individually adjusting or programming parameter settings of luminaries. For example a user can manually adjust one or more luminaries in a room, via inputs at wall panel 106 perhaps, or even by using controls on a particular luminaire such as a lamp 104. Values of brightness and/or colour can be altered, until the user is satisfied with the overall effect. The user can then input an instruction to a user terminal to store the current settings, and will typically assign a name or ID to the scene created. Illumination settings could also be obtained from an external source, such as the internet for example. It may be possible to input the number and nature, and possibly also the position, of luminaires present in the given environment, such as environment 102 of FIG. 1, so that downloaded settings are appropriately mapped into the environment. It may also be possible for a more generalised scene setting, such as an overall brightness, or colour or colour temperature to be downloaded, and for local processing, e.g. performed by a device such as intermediate device 210, to derive specific parameter values for each luminaire, based on the generalised scene.

Illumination can also be controlled, or control can be augmented, by information gathered on environmental conditions in the vicinity of the system. Ambient light level for example can be used to automatically adjust the output of luminaires, or program certain settings. Time of day may also be used, as well as information on whether a person or persons are present, and possibly also the identity of that person(s), to control illumination output based on predetermined settings or values, or combinations of such settings or values. Such environmental conditions or information can be used by terminal 206 or 208, and/or device 210 to allow at least a degree of automation in controlling the output of luminaires 204. Automated control of settings can be augmented or overwritten by manual input if desired.

In embodiments, a sensor or sensor interface 216 provides information of sensed environmental information or inputs to one or more elements of the functional group 212. For example, sensors can include a light sensor, a PIR sensor, and/or an RFID sensor. A clock input for providing the current time of day can also be provided. Such sensors can be located in or around environment 102 of FIG. 1, and could be wall or ceiling mounted for example. In embodiments, sensors could be integrated into any or luminaires 104. Additionally or alternatively, terminals 206 or 208, or device 210 may include sensors to provide such information, particularly in the case of a mobile terminal in the form of a smartphone for example.

FIG. 3 illustrates data representing illumination settings for a given scene.

The data shows parameter values corresponding to different luminaries for a given scene. In this example, a lighting system includes five individually addressable luminaires, but the particular scene, say scene X, requires only three numbers 1, 2 and 4. For each of these luminaires, a brightness value and a colour value are provided. An effect value is an example of a possible further parameter which could be included, but which is not used in this example. Luminaires 3 and 5 are not used, and therefore parameter values are not included for these luminaires, for this scene, or illumination setting.

Single numerical values of brightness and colour are provided here as simplistic examples, but it will be understood that different embodiments may use different values or combinations of values to represent parameters. For example colour could be represented by three values in RGB or L*a*b* colour space, and some parameters such as an off/on parameter may take a Boolean true/false value. Further parameters such as a time or duration could also be included.

In an example of a typical user operation for recalling a setting for use for example, the user may view a list of possible settings on a smartphone acting as a mobile user terminal 108. Using a touchscreen interface on the smartphone, the user can scroll and select a particular setting or scene. Considering the case that the settings are not already stored at the luminaires, the specific values of parameters for the scene (and which luminaires those parameters apply to) may be stored on the smartphone and sent directly to the relevant luminaires from the smartphone, for example using Bluetooth. Alternatively the settings could be stored on the smartphone and sent to the luminaires via an access point, or a lighting bridge, acting as intermediate device 210. Data transfer from the access point or lighting bridge to the luminaires may be via a different protocol, such as Zigbee. However, the settings could be stored on the lighting bridge, and the mobile user terminal interrogates the bridge to provide a list to the user, and sends an instruction back to the bridge, identifying a setting, and causing the relevant parameter values to be forwarded from the bridge to the relevant luminaires. As a still further possibility, settings can be stored on network server 214, which may be accessed via the internet for example. Via a web browser or app on the smartphone, a user can access data stored on the server 214 (either directly via 4G for instance, or via an access point or router, such as intermediate device 210), which may include stored illumination settings, browse such settings and optionally download setting data to be stored on the smartphone and/or an intermediate device 210 such as a lighting bridge, and/or to be sent to the luminaires. The settings in such a case are sent to the individual luminaires by unicast. Luminaires use the received settings to output the desired illumination.

FIG. 4 illustrates data representing parameter values stored in a given luminaire.

The data shows parameter values corresponding to different scenes for a given Luminaire. Luminaire 1 of the example of FIG. 3 is used, and values for brightness and colour parameters of 24 and 122 respectively are used. Parameter values for two further scenes, scene Y and scene Z, are shown stored in Luminaire 1 also.

In a case that the settings for a scene to be recalled are already stored at the relevant luminaires, an example of a typical user operation for recalling a scene may involve a user viewing a list of possible scenes on a mobile terminal, such as 108 or 208, and selecting a desired scene. Only an indication of the selected scene then needs to be sent to the luminaires. This indication is common to all luminaires and can be sent by groupcast or broadcast. The indication can be sent directly from the mobile terminal to the luminaires, or can be sent via an intermediate device 210, such as wall panel 106 or a lighting bridge. Luminaires receiving the indication of the desired scene access the locally stored lighting settings referenced to the indicated scene to output the desired illumination.

In certain circumstances, it is possible for some, but not all of the luminaires associated with a given scene, to have illumination settings already stored. In such a hybrid situation, a groupcast instruction can be sent to those luminaires where settings are stored, and the settings including individual parameter values are sent to the remaining lumianires, which do not have (or do not yet have) the necessary information stored locally. Knowledge of which luminaires do and do not have the settings stored locally can be maintained at one or a combination of the components of group 212 of FIG. 2 for example.

In an embodiment, a standard illumination setting is stored in all or a group of luminaires corresponding to, say, a default light state. A group cast can then be used as a filter to turn on (with the stored default light state) desired luminaires. For example, three illumination patterns are desired, A, B and C, all having the same settings for each luminaire, but including different luminaires: pattern A including luminaires 1, 2 and 3; B including luminaires 1, 4 and 5; and C including luminaires 1, 2 and 6. It can be seen that luminaire 1 is included in three patterns, and luminaire 2 is included in two patterns. Storing three illumination settings in luminaire 1 (corresponding to A, B and C) results in duplicating sets of identical parameters. Instead the illumination settings can be stored once, and an on/off filter can be groupcast to luminaires 1, 2 and 3 for pattern A for example.

In an embodiment, each luminaire may be able to store up to 50 illumination settings, each corresponding to a given scene. Other elements of a lighting system such as Device 210 and user terminals 206 and 208 for example may be able to store a greater number of illumination settings upwards of 100 or 200 in examples.

In the example of Zigbee, each luminaire is contacted every 1-2 seconds. If there is a need to dispatch an illumination setting for a scene, up to 5 scenes can be dispatched in this timeframe. I.e. 5 scenes with 50 lights each can take up to 100 s to be dispatched.

Where the relevant illumination setting is not stored in the luminaire in advance, unicast recall typically takes 150 ms per light. Therefore a scene with 20 lights may take approximately 3 seconds, which is clearly visible.

Broadcast recall, which can be used where the required illumination setting is already available at the luminaire, can have up to 250 ms delay between first and last light, which delay is not typically perceivable, but more commonly delays of less than 100 ms are achieved.

Figure 5:
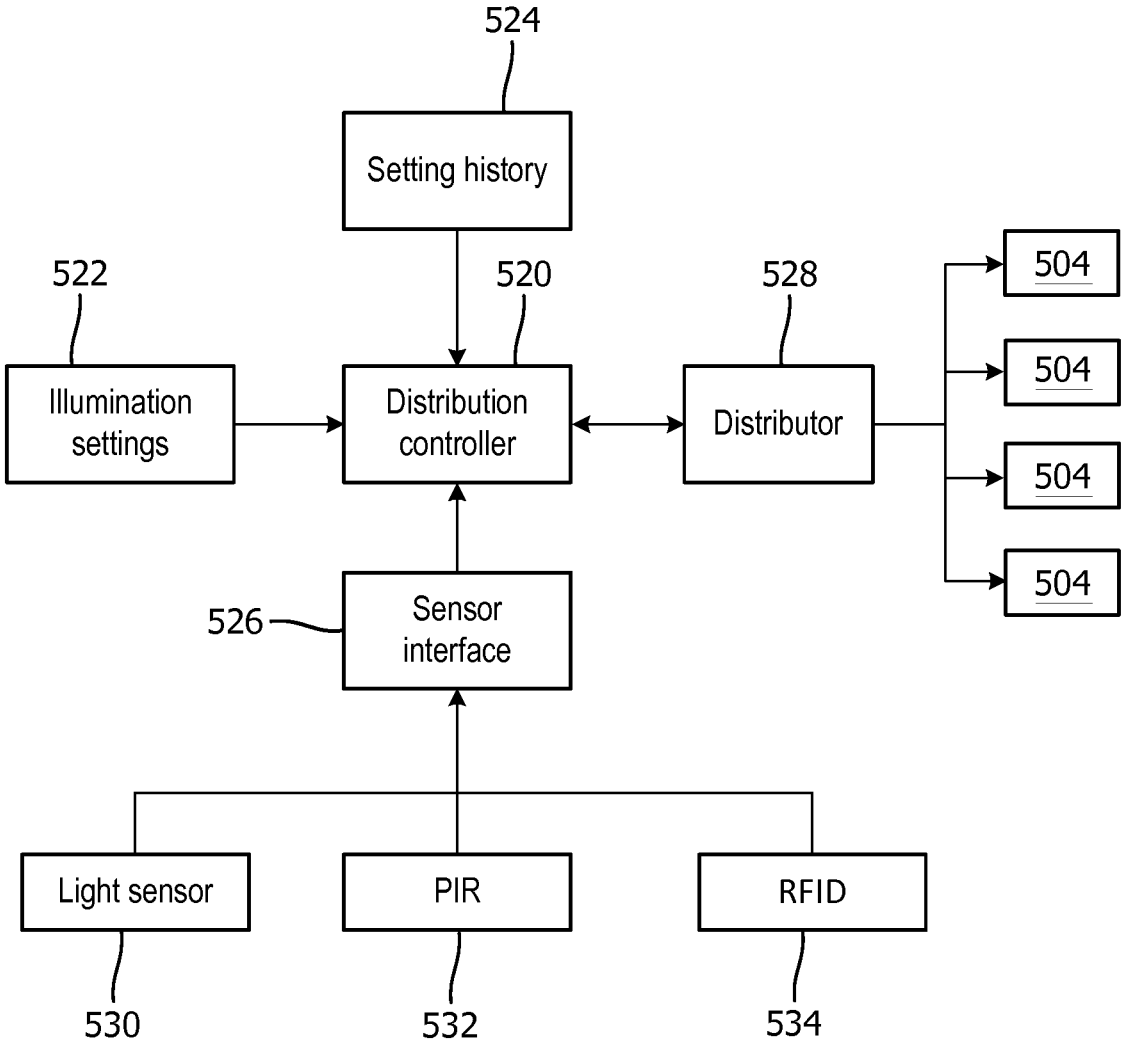
FIG. 5 shows a functional configuration of an example system for distributing illumination settings.

FIG. 5 shows a functional configuration of a system for distributing illumination settings to be stored in luminaires.

A distribution controller 520 has access to stored illumination settings 522, and also to stored setting history 524. The stored illumination settings are data such as that shown in FIG. 3 for each stored scene. The stored setting history stores data representing the usage history of each stored scene. This may be in the form of a complete historical log indicating time of use for each setting, or may be summarised in the form of statistical parameters such as most frequently used setting, last used setting, setting used for the longest duration etc. These statistics may be further divided out by user, or by defined period or time of day for example. The setting history is continuously updated. The stored setting history may in some instances be combined together with the stored illumination settings.

In embodiments, the distribution controller can optionally also receive information from one or more sensors such as a light sensor 530, PIR sensor 532 and RFID receiver 534 via a sensor interface 526. The sensor interface may for example be the same as interface 216 of FIG. 2, or integrated into a device such as terminals 206 or 208, or device 210 of FIG. 2. The light sensor can for example provide data on ambient light conditions e.g. night, day, direct sunlight, overcast etc. The PIR sensor can monitor for presence or movement of a person for example, while the RFID receiver could be used to determine an ID of a user carrying and RFID tag or token. The distribution controller may receive a clock signal, which may already be included as part of a processor architecture in the controller for example.

The distribution controller evaluates illumination settings to determine which settings should be stored at luminaires 504, and distributor 528 effects the sending of the relevant settings data to the appropriate luminaire or luminaires. This evaluation uses some or all of the information provided by functional blocks 522, 524 and 526, and will be explained by way of example in more detail below. Distributor 528 records which settings are stored in which luminaires, and can optionally pass this information back to distribution controller 520, for use in the evaluation. The luminaires 504 store received data in a format such as that shown in FIG. 4.

The functions of the distribution controller and the distributor may be implemented in the same physical device or in different devices. The functions of the distribution controller and the distributor may be implemented in a single physical device such as a user terminal, such as 106 or 108 of FIG. 1, or 206 or 208 of FIG. 2, or an intermediate device such as 210 of FIG. 2.

Alternatively the functions may be distributed between such devices in a grouping such as 212 of FIG. 2, and some functions may additionally or alternatively be distributed to a network server 214 of FIG. 4. Accordingly, in one embodiment, distribution controller 520 is implemented in a mobile user terminal 208 of FIG. 2, and distributor 528, setting history 524, and sensor interface 526 are implemented in a lighting bridge acting as an intermediate device 210 of FIG. 2. Illumination settings 522 are stored in part on the mobile user terminal, and in part on a network server 214 of FIG. 2, to which the mobile user terminal has access. The determination of settings to be stored is therefore performed by the mobile user terminal, and details of the determined settings, and the settings themselves, sent to the lighting bridge, for forwarding to the individual luminaires. In such an example, this determination, or at least part of this determination, can be performed by the mobile user terminal, and may occur even when the mobile terminal is away from, and disconnected from the lighting bridge. For example, the average brightness of an illumination setting and/or the present time may be sufficient to determine a priority metric in some instances, which information can be available to the mobile terminal without access to the lighting bridge.

In a variation of the above embodiment, the function of the distribution controller is implemented remotely, at a network server such as 214 of FIG. 4. The function may be performed without the involvement of a user terminal, with the lighting bridge being in direct communication with the network server, for example over the internet.

Figure 6:
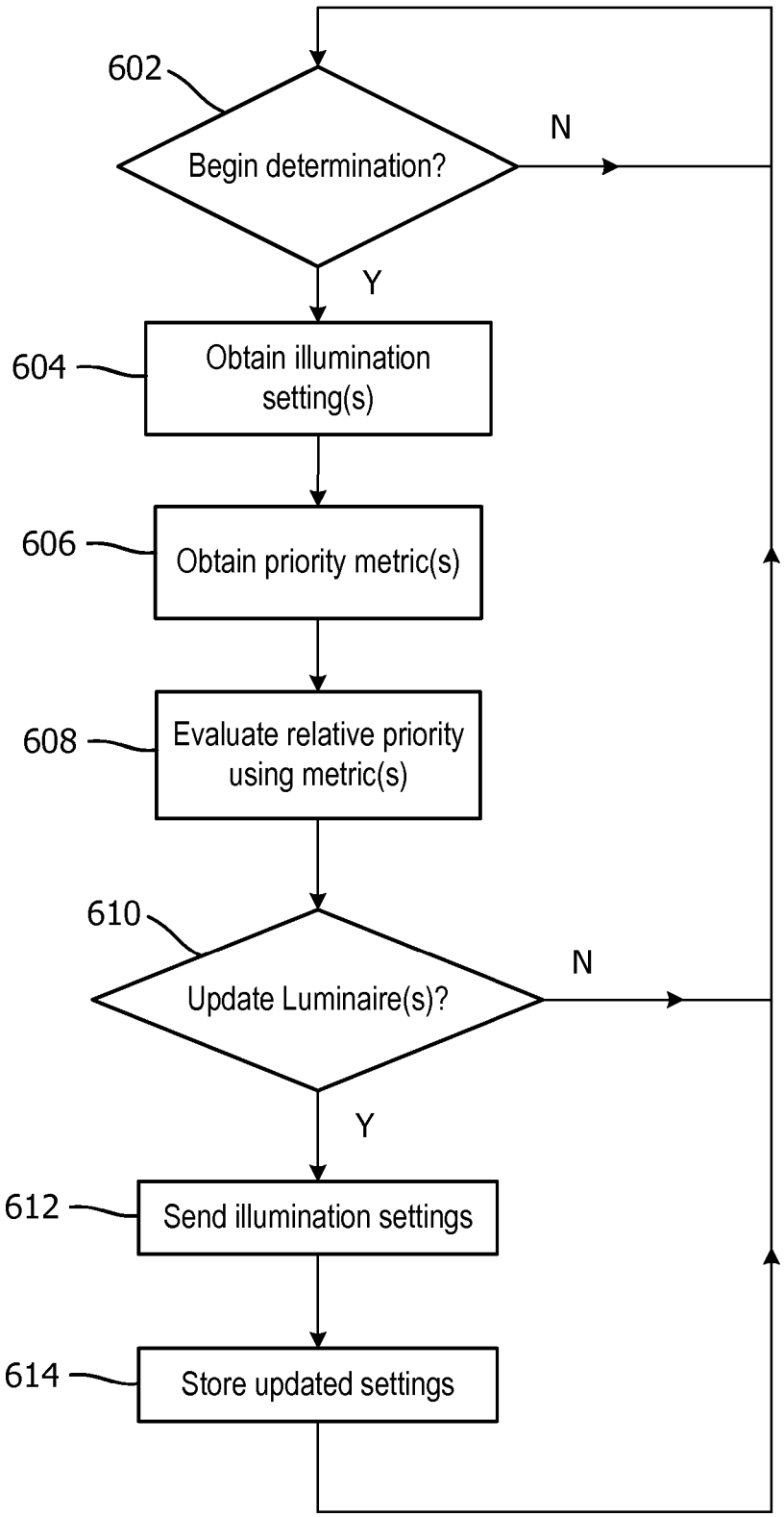
FIG. 6 is a flow diagram illustrating an example of a process for evaluation illumination settings.

FIG. 6 is a flow diagram illustrating an example of a process for evaluating illumination settings and determining settings to be stored at luminaires.

At step 602, it is determined whether or not to begin the process. As noted above, the start of the determination process can be time based, occurring at predetermined intervals or specific times. Equally, trigger events can begin the process. For example a user input such as the creation of a new illumination setting, or recall of an illumination setting, or a sensor input such as detection of proximity of a user a particular user entering a room for example.

The following list provides examples of possible trigger factors:

Creation of a new scene by a user
Use of a scene which has not yet been sent
Expiry of a timer or counter
Predetermined time of day
Detection of presence of a user
Ambient light level Trigger factors can be determined by input from one or more of sensors such as sensors 530, 532, 534 of FIG. 5 for example, by input from a user terminal 106 or 108 of FIG. 1, or 206 or 208 of FIG. 2, or by a counter or clock for example.

If it is determined to begin, an illumination setting is obtained at step 604. The obtained setting can be referred to as a candidate setting, and can be obtained from a memory storing settings, or could be a new setting input by a user or obtained from a network for example.

At step 606 one or more priority metrics is obtained for the candidate illumination setting. Priority metrics may be previously stored and accessed from a memory in some cases, or calculated or derived if they are not stored, or require updating.

The following list provides examples of factors which may be used as a metric, or on which a metric can be based:

Most recently used setting
Most frequently used setting
Setting created/obtained most recently
Setting most frequently used in a given time period
Number of luminaires in a setting
Number of parameters in a setting
Time of day associated with setting
Ambient light level associated with a setting
User ID associated with setting At step 608, the relative priority of the candidate setting is evaluated using the obtained metric or metrics.

The metric or metrics allow illumination settings to be compared to determine relative suitability or likelihood of being required in a given situation. In some instances, metrics are compared individually. For example where a simple numerical value is used as a metric, such as the number of luminaires included in the setting, the greater or greatest value can be determined. Alternatively, if the time since last recall is used as a metric, the more recent or most recent setting can be determined. Rather than comparing direct values such as time values and statistical values, a score can be assigned as a metric, based on an underlying factor associated with the illumination setting. For example if the time since last recall is less than 3 hours, a score of 10 is assigned; between 3 hours and 12 hours a score of 5 is assigned; and more than 12 hours a score of 0 is assigned. Scores can be assigned so that metrics relating to different units of physical entities can be directly compared for example frequency of use and number of parameters included. In some cases, a metric may indicate absolute priority over other settings, and/or indicate a default setting. For example the most recently used setting could have a flag set to 1, with all other settings set to 0.

Metrics may be used in combination for the purposes of evaluation or comparison. If a score based system is used, scores representing two or more factors or metrics can be numerically combined in order to create a single metric to evaluate illumination settings. Scores can reflect different weightings assigned to different contributing factors.

Logic rules, formed for example using Boolean expressions or operators, may also be used to compare and/or combine metrics, and additional inputs such as time of day or ambient light level, to determine which settings should be sent to the luminaire(s) according to relative priorities. Some examples of such rules/expressions include:

Prioritise/send a setting if is used 3 or more times in the last 24 hours, and includes more than 10 luminaires.
If a new setting is created, prioritise/send it if it includes more than 20 luminaires.
If a setting stored in a luminaire has not been recalled for one month or more, replace it with a more recently used setting.
If ambient light level falls below a threshold, prioritise/send settings having higher brightness.

Also, metrics and combinations of metrics can be obtained and combined to determine the relative priorities of illumination settings corresponding to a desired set of user profiles, preferences or schedules, allowing the illumination controller to advantageously pre-load settings into luminaires intelligently. For example, if it determined that a particular user is present, then the last setting recalled by that user can be prioritised.

Some settings are inherently more suited to certain times of day (e.g. "energizing" in the morning, "relaxing" in the evening, "nightlight" during the night), however in embodiments the illumination controller can analyse behavioural patterns, to learn the schedule and preferences of a user, such as circadian rhythms, and create and update metrics and/or rules for evaluation and application of those metrics. Some examples include:

If the present time is between 6 am and 10 am, prioritise/send setting "sunrise"

If user "John" is present, then prioritise/send the five settings most recently used by John If user "John" is present, and the present time is between 6 pm and 10 pm, then prioritise/send the setting "sunset2", and the four settings most recently used by John between 6 pm and 10 pm.

At step 610, it is determined whether to update one or more luminaires, based on the evaluation of relative priorities at 608. The evaluation at 608 may result in a global ranking of illumination settings, and this may be used to determine which settings are to be sent to which luminaires, irrespective of the settings currently stored settings in the luminaires. For example the top 20 settings by priority are determined to be sent for storing at the luminaires.

It may be desirable for some embodiments to take into account the settings currently stored in each luminaire. In the example system of FIG. 5, the distribution controller 520 can receive information about the currently stored settings in the luminaires from distributor 528, and use this information as part of an evaluation of illumination settings. In one embodiment, evaluation may be performed relative only to the currently stored settings, to determine if one or more stored settings should be displaced according to the evaluation. In this way, a setting is only sent to a luminaire if it is prioritised above the currently stored settings. In another embodiment, settings currently stored in luminaires can also be referenced to determine whether a scene can be stored in all luminaires to which it relates. For example, if a scene relates to three luminaires, but only two of those luminaires is able to store scene settings (eg because of memory constraints in the third luminaire) that scene may be assigned a lower ranking, or conversely another scene for which settings for all luminaires can be stored may be prioritised.

A threshold may be used to determine whether a luminaire is to be updated, even if it is determined that a setting of higher priority exists, to ensure that an illumination setting is sufficiently "better" than a scene which is to be replaced. Settings may also be kept for a minimum amount of time at each luminaire (for example, 1 day or 1 week) before being replaced. This can help prevent cycling rapidly through settings.

If it is determined that one or more luminaires are to be updated at 610, the relevant illumination settings are dispatched at step 612. The relevant parameter values (such as those in FIG. 3 for example) for each luminaire are extracted, and addressed to the appropriate luminaire, together with data to allow them to be stored in a format appropriate for recall (such as that illustrated schematically in FIG. 4 for example).

At step 614, the newly updated settings sent to and stored at each luminaire are optionally stored, for use in the evaluation step if required.

It will be understood that the present invention has been described above purely by way of example, and modification of detail can be made within the scope of the invention. Each feature disclosed in the description, and (where appropriate) the claims and drawings may be provided independently or in any appropriate combination.

The various illustrative logical blocks, functional blocks, modules and circuits described in connection with the present disclosure may be implemented or performed with a general purpose processor, a digital signal processor (DSP), an application specific integrated circuit (ASIC), a field programmable gate array (FPGA) or other programmable logic device (PLD), discrete gate or transistor logic, discrete hardware components, or any combination thereof designed to perform the function or functions described herein, optionally in combination with instructions stored in a memory or storage medium. A described processor may also be implemented as a combination of computing devices, e.g., a combination of a DSP and a microprocessor, or a plurality of microprocessors for example. Conversely, separately described functional blocks or modules may be integrated into a single processor. The steps of a method or algorithm described in connection with the present disclosure may be embodied directly in hardware, in a software module executed by a processor, or in a combination of the two. A software module may reside in any form of storage medium that is known in the art. Some examples of storage media that may be used include random access memory (RAM), read only memory (ROM), flash memory, EPROM memory, EEPROM memory, registers, a hard disk, a removable disk, and a CD-ROM.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. An illumination system comprising:

one or more luminaires adapted to receive and store illumination settings; and an illumination controller comprising:

a distributor adapted to obtain previous usage information about the illumination settings stored in the one or more luminaires; and a distribution controller adapted to evaluate the previous usage information about the illumination settings by:

receiving the previous usage information about the illumination settings for the one or more luminaires from the distributor;

obtaining one or more priority metrics for the illumination settings;

evaluating the previous usage information about the illumination settings using the one or more priority metrics to generate a relative priority of the illumination settings; and determining, based on the relative priority of the illumination settings, updated illumination settings to be stored at the one or more luminaires, wherein the distributor is further adapted to send the updated illumination settings to the one or more luminaires for storing.

2. The illumination system according to claim 1, wherein a priority metric of the one or more priority metrics is based on at least one of a group consisting of a creation of the illumination settings, a last use/recall of the illumination settings among the one or more luminaires, a frequency of use of the illumination settings among the one or more luminaires, and a pattern of use among the one or more luminaires.

3. The illumination system according to claim 1, wherein the one or more priority metrics applies a weighting factor to the illumination settings.

4. The illumination system according to claim 1, wherein a priority metric of the one or more priority metrics is based on at least one of a group consisting of a total number of luminaires associated with each of the illumination settings, a data size of each of the illumination settings, and a number of different lighting parameters in each of the illumination settings.

5. The illumination system according to claim 1, wherein each priority metric of the one or more priority metrics is based on an environmental input to the illumination controller.

6. The illumination system according to claim 1, wherein each priority metric of the one or more priority metrics is based on at least one of a group consisting of a time of day a presence of a user, and an identification of a user.

7. The illumination system according to claim 1, wherein the distribution controller is further arranged to instruct the distributor to send the updated illumination settings to the one or more luminaires on occurrence of a trigger event.

8. The illumination system according to claim 7, wherein the trigger event comprises at least one of a group consisting of a periodic time interval, a time of day, an input of a new illumination setting to the illumination controller, a use/recall of an illumination scene by a user, and a detection of proximity of a user.

9. The illumination system according to claim 1, wherein the illumination settings include values for setting lighting parameters of the one or more luminaires, said lighting parameters including at least one of a group consisting of a brightness, a color, timing, and a lighting effect.

10. The illumination system according to claim 1, wherein the distribution controller is further arranged to instruct the distributor to send the updated illumination setting to be stored at the one or more luminaires based on a user profile, a preference, or a schedule.

11. The illumination system according to claim 1, wherein each priority metric of the one or more priority metrics is based on information of settings already stored at said one or more luminaires.

12. The illumination system according to claim 1, wherein the one or more priority metrics follow a plurality of logic rules.

13. The illumination system according to claim 1, wherein the updated illumination settings are sent to the one or more luminaires when a threshold is exceeded.

14. The illumination system according to claim 1, wherein the illumination controller is part of a handheld device that wirelessly communicates with the one or more luminaires.

15. The illumination system according to claim 1, wherein the illumination controller is loaded on a network server.

16. The illumination system according to claim 1, wherein the updated illumination settings are sent by the illumination controller to an intermediate device before being sent to the one or more luminaires.

17. A method of controlling distribution of updated illumination settings in an illumination system comprising a plurality of luminaires, said method comprising:

receiving previous usage information about a plurality of existing illumination settings for the plurality of luminaires;

obtaining one or more priority metrics for the existing illumination settings of the illumination system;

evaluating the previous usage information about the existing illumination settings using the one or more priority metrics to generate a relative priority of the existing illumination settings;

determining illumination recall settings for the plurality of luminaires based generating the relative priority of the existing illumination settings; and sending the illumination recall settings to the plurality of luminaires for storing.

18. A non-transitory computer readable medium comprising computer readable program code embodied therein for a method for controlling distribution of updated illumination settings in an illumination system comprising a plurality of luminaires, the method comprising:

receiving, by an illumination controller, previous usage information about a plurality of existing illumination settings for the plurality of luminaires;

obtaining, by the illumination controller, one or more priority metrics for the existing illumination settings of the illumination system;

evaluating, by the illumination controller, the previous usage information about the existing illumination settings using the one or more priority metrics to generate a relative priority of the existing illumination settings;

determining, by the illumination controller, illumination recall settings for the plurality of luminaires based generating the relative priority of the existing illumination settings; and sending, by the illumination controller, the illumination recall settings to the plurality of luminaires for storing.

* * * * *